US007971574B2

(12) United States Patent
Kondoh

(10) Patent No.: US 7,971,574 B2
(45) Date of Patent: Jul. 5, 2011

(54) BACKPRESSURE VALVE AND FUEL SYSTEM HAVING THE SAME

(75) Inventor: Jun Kondoh, Nagoya (JP)

(73) Assignee: Denso Corporation, Kariya (JP)

( * ) Notice: Subject to any disclaimer, the term of this patent is extended or adjusted under 35 U.S.C. 154(b) by 390 days.

(21) Appl. No.: 12/333,590

(22) Filed: Dec. 12, 2008

(65) Prior Publication Data

US 2009/0151700 A1 Jun. 18, 2009

(30) Foreign Application Priority Data

Dec. 13, 2007 (JP) ..... 2007-322577

(51) Int. Cl.
*F02M 69/54* (2006.01)
*F02M 69/00* (2006.01)

(52) U.S. Cl. ..... 123/457; 123/498

(58) Field of Classification Search ..... 123/457, 123/459, 468, 478, 456, 447, 514; 239/102.2; 137/493

See application file for complete search history.

(56) References Cited

U.S. PATENT DOCUMENTS 6,899,069 B2 * 5/2005 Mattes et al. ..... 123/90.12
7,520,267 B2 * 4/2009 Toyoshima ..... 123/447
2006/0016906 A1 1/2006 Matsumoto

* cited by examiner

*Primary Examiner* — Mahmoud Gimie
(74) *Attorney, Agent, or Firm* — Nixon & Vanderhye PC

(57) ABSTRACT

A return fuel passage is configured to communicate an outlet of a low-pressure fuel pump with a back pressure side of a fuel injection device. The return fuel passage is configured to partially return fuel from the back pressure side to the fuel tank to control fuel pressure at the back pressure side in response to fuel injection. In a starting operation a backpressure control valve communicates the outlet of the low-pressure fuel pump with the back pressure side and blocks the fuel tank from both the outlet of the low-pressure fuel pump and the back pressure side. In a normal operation, the backpressure control valve communicates the back pressure side with the fuel tank and blocks the outlet of the low-pressure fuel pump from both the fuel tank and the back pressure side.

10 Claims, 6 Drawing Sheets

BACKPRESSURE VALVE AND FUEL SYSTEM HAVING THE SAME

CROSS REFERENCE TO RELATED APPLICATIONS

This application is based on and incorporates herein by reference Japanese Patent Application No. 2007-322577 filed on Dec. 13, 2007.

FIELD OF THE INVENTION

The present invention relates to a backpressure control valve and a low-pressure fuel system having the backpressure control valve.

BACKGROUND OF THE INVENTION

Conventionally, a generally known diesel engine is provided with a fuel injection device, which injects the high-pressure fuel. Such a fuel injection device includes, for example, an injector mounted to each cylinder of the engine. In the fuel injection device, a low-pressure fuel pump draws fuel from a fuel tank and preliminary pressurizes the drawn fuel. The low-pressure fuel pump feeds the pressurized fuel as low-pressure fuel to a high-pressure pump. The high-pressure pump further pressurizes the low-pressure fuel to be high-pressure fuel at fuel injection pressure.

For example, JP-A-2006-46323 proposes a common rail type fuel injection device having a piezo injector, which is excellent in response. The piezo injector includes a hydraulic pressure transmission mechanism, which transmits displacement of a piezo stack via hydraulic pressure. The hydraulic pressure transmission mechanism actuates a control valve for controlling pressure in a control chamber at the side of a nozzle needle. Thus, the hydraulic pressure transmission mechanism controls the nozzle needle to open and close nozzle holes so as to therethrough inject high-pressure fuel. The hydraulic pressure transmission mechanism includes a first piston, which is located at the side of the piezo stack, a second piston, which is located at the side of the control valve, and a hydraulic chamber provided between the first and second pistons. The hydraulic chamber and the first and second pistons are located in series in a cylinder. In the present structure, the hydraulic chamber containing fuel is interposed between the cylinders. Therefore, thermal expansion caused differently in components can be absorbed by supplying fuel into the hydraulic chamber and leaking fuel from the hydraulic chamber. Thus, pressure transmission and fuel injection performance can be maintained.

The piezo stack extends when being energized, and thereby increase pressure in the hydraulic chamber so as to transmit driving force to the control valve for fuel injection. At the time of stop of the fuel injection, the piezo stack is de-energized, and the driving force of the piezo stack is eliminated. Therefore, the hydraulic chamber is reduced or increased in pressure in response to the amount of fuel leak, and thereby fuel flows into the hydraulic chamber. That is, the hydraulic chamber is charged with fuel from the back pressure side of the injector.

In the present conventional art, the back pressure side of the injector connects with the leak line through which fuel is returned to the fuel tank. Therefore, fuel is leaked from the back pressure side of the injector or fuel flows into the back pressure side of the injector in conjunction with fuel injection of the injector, and thereby injection performance is supposed to be maintained. However, according to study of the present inventors, startability may be impaired in exchange for injection performance. The reason will be described as follows. So as to secure an injection performance, it is conceived to provide a check valve so as to maintain fuel in the leak line at positive pressure. By providing the check valve, fuel charge into the hydraulic chamber can be ensured, and fuel at the side of the back pressure of the injector can be maintained at positive pressure. In addition, so as to maintain the back pressure side of the injector at positive pressure regardless of engine starting or normal operation, low-pressure fuel needs to be fed to the back pressure side of the injector by communicating the feed line of the outlet of the low-pressure fuel pump with the back pressure side of the injector.

However, in the present circuit, in which the check valve maintains the back pressure side of the injector at positive pressure, the feed line may be regularly communicated with the leak line, i.e., the outlet of the low-pressure fuel pump may be regularly communicated with the fuel tank when the check valve causes a malfunction and regularly communicates therethrough. If the check valve causes a malfunction and regularly communicates therethrough, the low-pressure fuel pump cannot properly pressurize fuel. As a result, startability of the engine may be impaired, and engine operation cannot be maintained. Furthermore, in the present circuit, in which the feed line of the outlet of the low-pressure fuel pump is connected to the back pressure side of the injector, another check valve needs to be provided to the feed line so as to enable restarting in the case where fuel entrains air. Therefore, the two check valves are needed in the present circuit, and consequently the entire system of the circuit increases in cost.

SUMMARY OF THE INVENTION

In view of the foregoing and other problems, it is an object of the present invention to produce a backpressure control valve, which is configured to maintain a back pressure side of a fuel injection device at positive pressure and restrict regular communication between an outlet of a low-pressure fuel pump with a fuel tank. It is another object of the present invention to produce a low-pressure fuel system having the backpressure control valve.

It is another object of the present invention to produce the backpressure control valve and the low-pressure fuel system having the backpressure control valve, each configured to maintain the back pressure side of the fuel injection device at positive pressure and restrict regular communication between the outlet of the low-pressure fuel pump with the fuel tank, with reduced number of components.

According to one aspect of the present invention, a backpressure control valve for a low-pressure fuel system having a return fuel massage, which is configured to communicate an outlet of a low-pressure fuel pump, which is for drawing fuel from a fuel tank, with a back pressure side of a fuel injection device, the return fuel passage configured to partially return pressurized fuel from the back pressure side to the fuel tank and control fuel pressure at the back pressure side in response to fuel injection from the fuel injection device to an internal combustion engine, the backpressure control valve comprises a switching unit configured to control communication between the outlet of the low-pressure fuel pump and the back pressure side, communication between the back pressure side and the fuel tank and communication between the outlet of the low-pressure fuel pump and the fuel tank. In a starting operation: the switching unit communicates the outlet of the low-pressure fuel pump with the back pressure side; the switching unit blocks the outlet of the low-pressure fuel pump from the fuel tank; and the switching unit blocks the back pressure side from the fuel tank. In a normal operation: the switching unit communicates the back pressure side with the fuel tank; the switching unit blocks the outlet of the low-pressure fuel pump from the fuel tank; and the switching unit blocks the outlet of the low-pressure fuel pump from the back pressure side.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
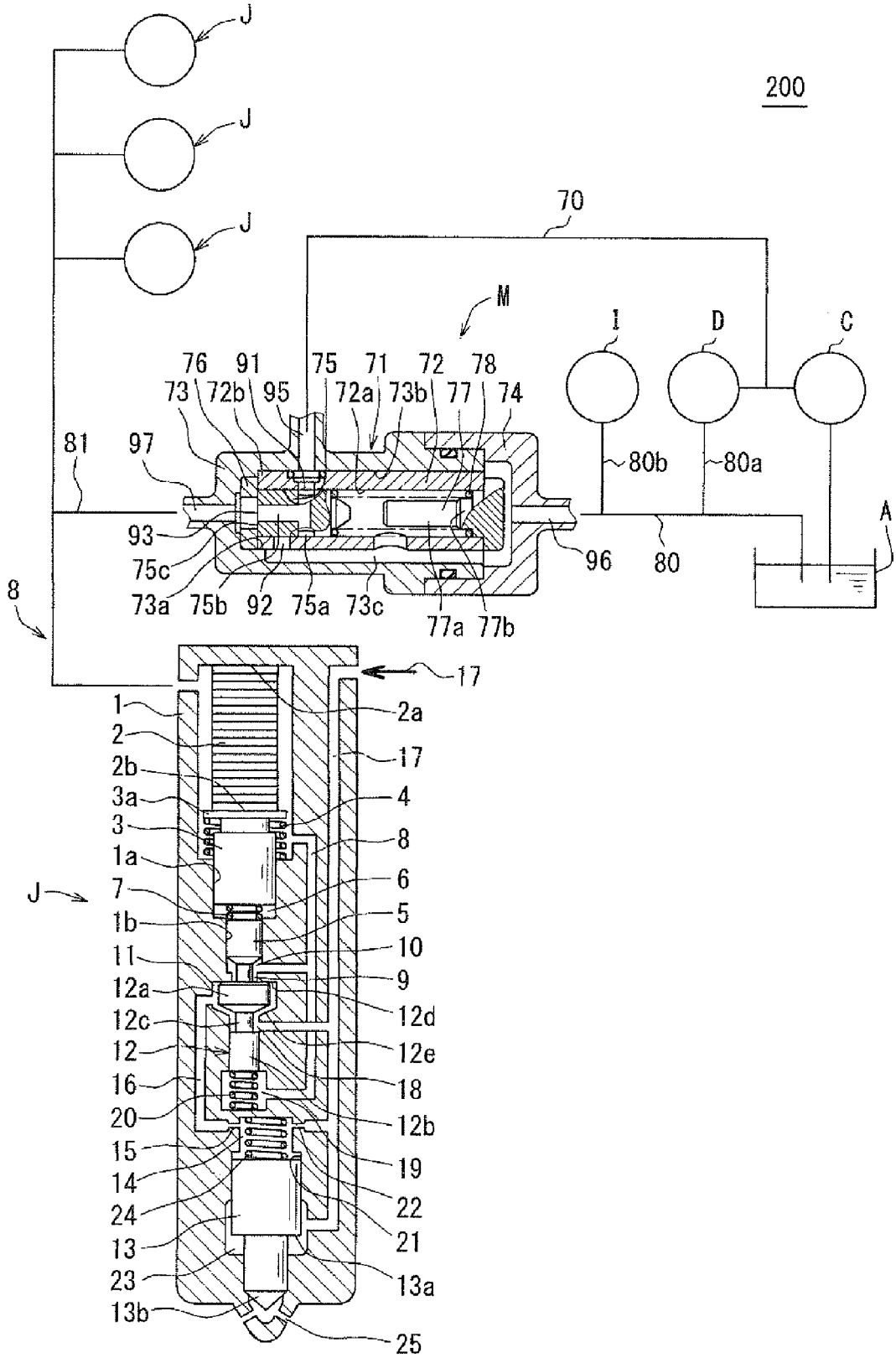
FIG. 1 is a schematic diagram showing a backpressure control valve applied to a low-pressure fuel system of a diesel engine according to a first embodiment of the present invention.
Figure 2:
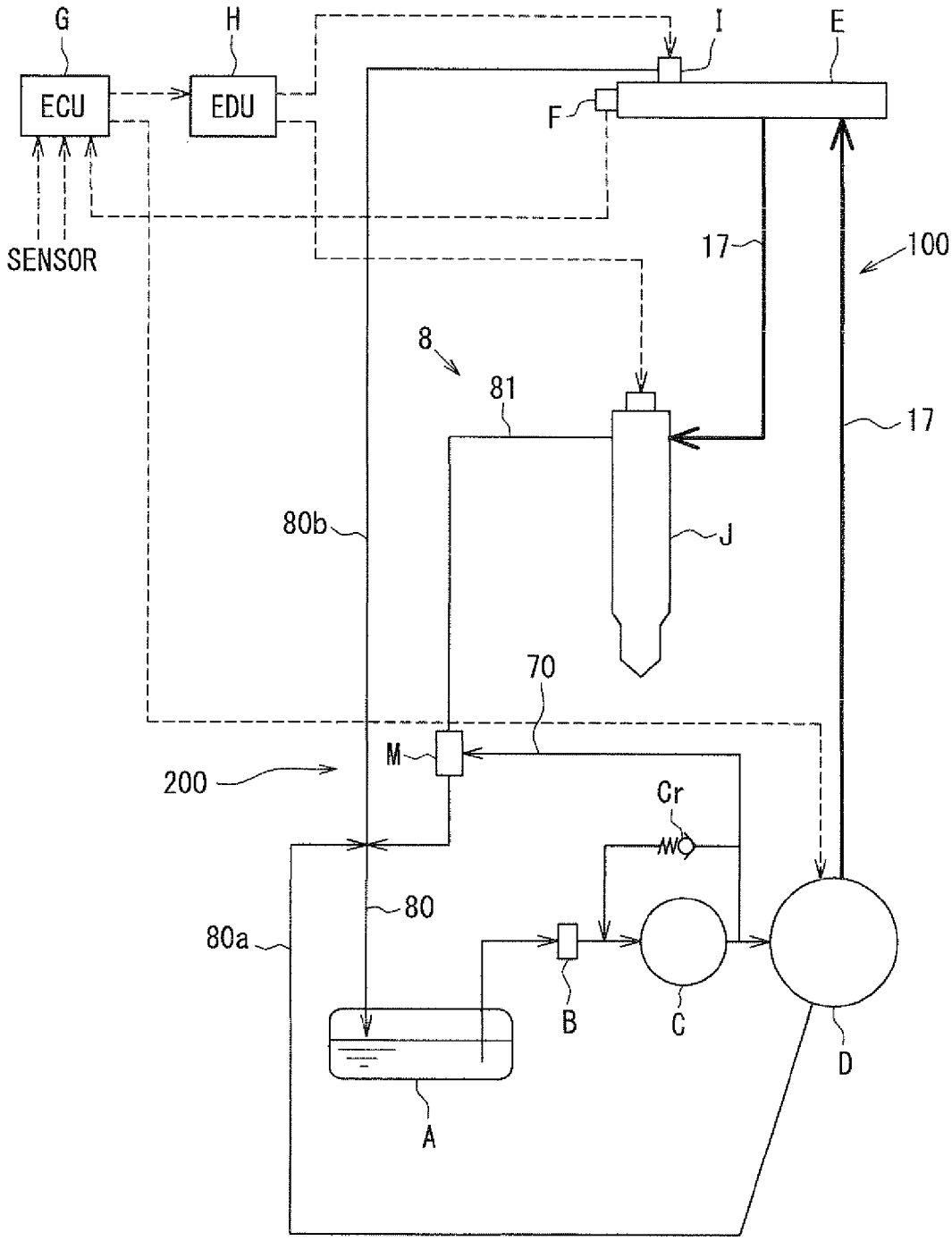
FIG. 2 is a schematic diagram showing the low-pressure fuel system having the backpressure control valve applied to a fuel injection system of the diesel engine according to the first embodiment of the present invention.
Figure 3A:
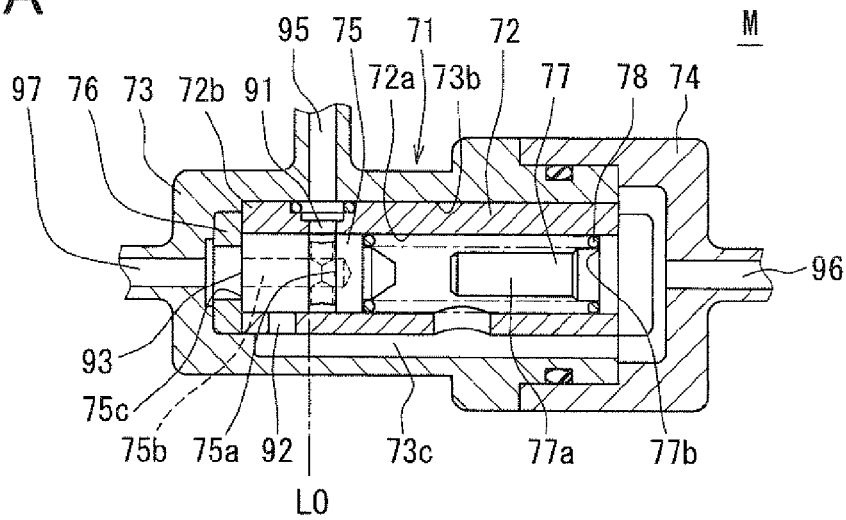
FIGS. 3A to 3C respectively depict the backpressure control valve in a condition at starting of the engine, a normal operation, and a condition in which malfunction occurs in the backpressure control valve.
Figure 3B:
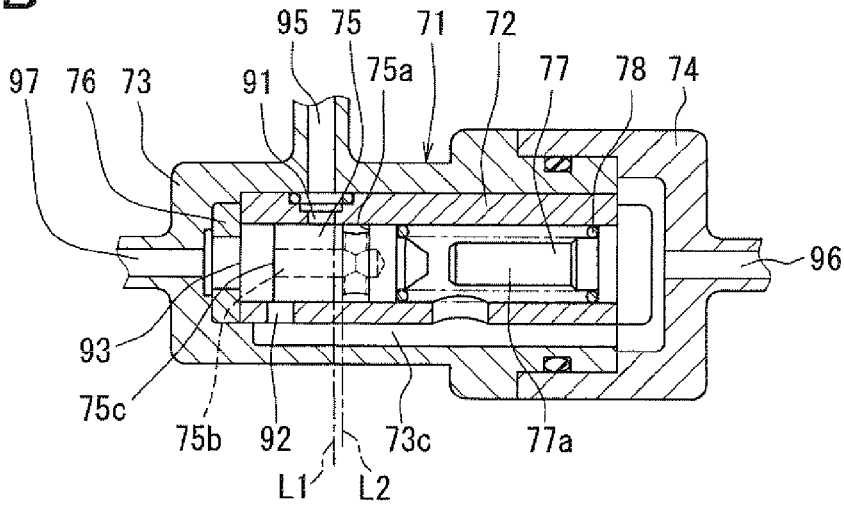
Figure 3C:
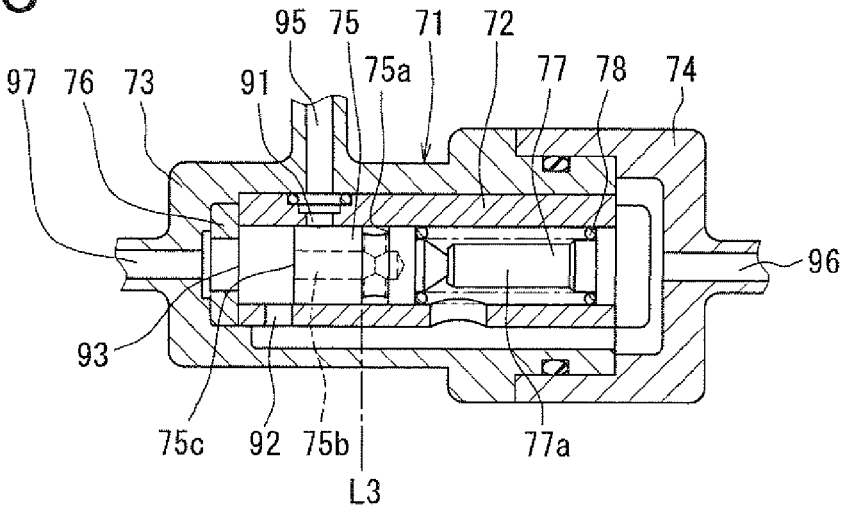

FIGS. 1 to 3C show a low-pressure fuel system having a backpressure control valve according to the present first embodiment. FIG. 2 shows a fuel injection system of a diesel engine provided with the low-pressure fuel system. FIGS. 3A to 3C show a backpressure control valve according to each engine operation state. The backpressure control valve shown in FIG. 1 corresponds to an operation shown in FIG. 3A.

As shown in FIG. 2, the engine fuel injection system performs fuel injection in each engine cylinder. In the present embodiment, the engine is a four-cylinder engine. The engine fuel injection system includes various components such as a fuel tank A, a feed pump B as a low-pressure fuel pump, a high-pressure pump D, a common rail E, and an injector J as a fuel injection device. The engine fuel injection system further includes a control circuit G as a control device, which controls an amount of fuel discharged from the high-pressure pump D and an injection quantity of high-pressure fuel from the injector J according to an engine operation state.

The fuel injection system includes a high-pressure fuel system 100 and a low-pressure fuel system 200. As shown by the thick solid lines in FIG. 2, the high-pressure fuel system 100 supplies compressed fuel in injection pressure. As shown by the thin solid lines in FIG. 2, the low-pressure fuel system 200 pumps fuel from the fuel tank A and returns fuel partially from the components C, D, E, I, J, which pressurize and accumulate fuel, to the fuel tank A. In FIG. 2, the dashed lines show electrical communications through which signals such as an instruction signal of the control circuit G are transmitted.

(High-Pressure Fuel System)

The high-pressure fuel system 100 includes the high-pressure pump D, the common rail E, and the injector J as main components. The high-pressure pump D is configured to further compress low-pressure fuel, which is discharged from the feed pump B, inside a compression chamber (not shown), thereby generating high-pressure fuel. Thus, the high-pressure pump D feeds high-pressure fuel to the common rail E.

The fuel, which is compressed by the high-pressure pump D, is accumulated in the common rail E. The high-pressure pump D is actuated by the engine (not shown). The amount of fuel discharged from the high-pressure pump D is greater than the fuel injection quantity, and thereby the common rail E is accumulated with the high-pressure fuel within a short time after starting of the engine.

Fuel pressure (common rail pressure) in the common rail E is detected by the pressure sensor F, and the detected signal is sent to the control circuit G. The high-pressure pump D further includes a controls device for electrically controlling the discharge amount of fuel. The control device is, for example, an intake metering valve (not shown). The intake metering valve is provided to a fuel passage and configured to control throttle of the fuel passage. The fuel passage leads fuel into the compression chamber which pressurizes fuel to be high pressure. The intake metering valve is manipulated according to a pump drive signal transmitted from the control circuit G. The intake metering valve controls an amount of fuel drawn into the compression chamber, thereby altering the amount of fuel fed to the common rail E. The control circuit G manipulates the intake metering valve of the high-pressure pump D, thereby controlling pressure in the common rail according to an engine operation state (vehicle running state).

The pressure regulator valve I is provided in the common rail E so as to partially release high-pressure fuel from the common rail E. The pressure regulator valve is manipulated by the drive circuit (electrical drive unit EDU) H according to the signal transmitted from the control circuit (electronic control unit ECU) G individually from the control of the discharge amount of the intake metering valve. The pressure regulator valve is configured to control the common rail pressure at predetermined pressure.

High-pressure fuel is distributed from the common rail E to the injector J attached to each engine cylinder. The drive circuit H manipulates the injector r J according to the signal transmitted from the control circuit G, thereby controlling opening and closing time points which determine a fuel injection characteristic. Thus fuel injection with optimal injection quantity can be performed according to the engine operation state.

The outlet of the high-pressure pump D, the common rail E, and the high-pressure fuel inlet of the injector J are regularly communicated with each other through a high-pressure passage 17. The high-pressure pump D may be provided separately with the feed pump C. Alternatively, the high-pressure pump D may be integrated with the feed pump C via a common pump drive shaft to construct a supply pump actuated by the engine.

(Low-pressure Fuel System)

The low-pressure fuel system 200 includes the fuel tank A, the feed pump C, the injector J, the backpressure control valve M, and the like as main components.

Fuel is drawn by the feed pump C from the fuel tank A through an inlet of the feed pump C and the filter B as a filter device. The feed pump C primary pressurizes fuel filtered through the filter B and thereby supplies the pressurized low-pressure fuel through the outlet of the feed pump C to the high-pressure pump D.

A pressure control unit (regulator valve) Cr is provided between the outlet of the feed pump C and the inlet of the feed pump C for controlling the feed pressure of the primarily pressurized fuel. The regulator valve Cr partially returns fuel, which is to be discharged to the high-pressure pump D, from the outlet of the feed pump C to the inlet of the feed pump C at the side of the fuel tank A, thereby controlling the feed pressure at predetermined set pressure.

Fuel (feed fuel, high-pressure fuel) supplied to each of the high-pressure pump D, the common rail E, and the injector J is partially discharged as surplus fuel into surplus fuel passages 80, 81. Thus, the surplus fuel is returned to the fuel tank A through the surplus fuel passages 80, 81.

More specifically, the feed pump C supplies sufficient fuel to the high-pressure pump D. Therefore, the supplied fuel is partially returned as the overflow fuel of the high-pressure pump D to the fuel tank A through a first surplus fuel passage 80*a*.

A pressure regulator valve I is provided to the common rail E. The pressure regulator valve I releases high-pressure fuel from the common rail E through a pressure release passage 80*b* as a second surplus fuel passage. The first surplus fuel passage 80*a* and the pressure release passage 80*b* define the surplus fuel passage 80. The pressure regulator valve I releases fuel, which is at pressure less than the pressure inside the common rail. The pressure of low-pressure fuel in the pressure release passage 80*b* of the surplus fuel passage 80 may be increased in dependence upon the fuel flow of the de-pressurized fuel.

Next, outflow and inflow of surplus fuel such as fuel leak related to the fuel injection of the injector J will be described with reference to FIG. 1.

As follows, a structure of the fuel injection valve J will be described. A piezo stack 2 as an injector actuator (piezo actuator) is accommodated in a casing 1. An upper end 2*a* of the piezo stack 2 is in contact with the casing 1. The piezo stack P has a generally known capacitor structure constructed by alternately stacking, i.e., laminating piezo-electric ceramic layers of a lead zirconate titanate (PZT) or the like and electrode layers, for example. The piezo stack P is configured to deform in extension and contraction directions along a laminar direction in the vertical direction in FIG. 1. A large-diameter piston 3 is slidable in the vertical direction inside a large-diameter cylinder 1*a* of the casing 1. The large-diameter piston 3 has a collar portion 3*a* at the upper side in FIG. 1, and the collar portion 3*a* is in contact with a bottom portion 2*b* of the piezo stack 2 by being exerted with biasing force from a large-diameter piston spring 4. A small-diameter cylinder 1*b* is provided in the casing 1. A small-diameter piston 5 is slidable in the vertical direction inside the small-diameter cylinder 1*b*.

A displacement amplification chamber 6 as a hydraulic chamber is a space defined by a lower end surface of the large-diameter piston 3, an upper end surface of the small-diameter piston 5, an inner periphery of the large-diameter cylinder 1*a*, and an inner periphery of the small-diameter cylinder 1*b*. A small-diameter piston spring 7 is accommodated in the displacement amplification chamber 6. The small-diameter piston spring 7 biases the small-diameter piston 5 downward.

The large-diameter piston 3, the small-diameter piston 5, and the displacement amplification chamber 6 construct a hydraulic pressure transmission mechanism, which transmits displacement of the piezo stack 2 via hydraulic pressure.

In the present embodiment, the small-diameter piston spring 7 is accommodate in the displacement amplification chamber 6. Alternatively, the small-diameter piston spring 7 may be omitted. In the present structure, a volume, which is needed for accommodating the small-diameter piston spring 7, becomes unnecessary, and thereby the displacement amplification chamber 6 can be reduced in volume. As a result, the hydraulic pressure transmission mechanism can be enhanced in performance of pressure transmission. Further, the injection performance of injector J can be enhanced.

Fuel flows from a low-pressure passage 8 through a gap between the outer wall of the large-diameter piston 3 and the inner wall of the large-diameter cylinder 1*a* into the displacement amplification chamber 6. The large-diameter piston 3 is displaced downward in response to extension of the piezo stack 2, thereby compressing fuel in the displacement amplification chamber 6 and displacing downward the small-diameter piston 5. More specifically, the piezo stack 2 extends in response to energization at the time of fuel injection, thereby transmitting driving force to the small-diameter piston 5 via fuel in the displacement amplification chamber 6, while increasing pressure in the displacement amplification chamber 6. At the time of stop of the fuel injection, the piezo stack 2 is de-energized, and the driving force of the piezo stack 2 is eliminated. Therefore, the displacement amplification chamber 6 is reduced or increased in pressure in response to the amount of fuel leak in the injection, and thereby fuel flows into the displacement amplification chamber 6. Consequently, fuel is charged from the low-pressure passage 8 at the back pressure side of the injector J into the displacement amplification chamber 6. Thus, the displacement amplification chamber 6 is charged with fuel.

In the present structure, the diameter of the large-diameter piston 3 is greater than the diameter of the small-diameter piston 5. Therefore, the displacement of the large-diameter piston 3 is amplified and converted into the displacement of the small-diameter piston 5.

When the large-diameter piston 3 moves downward to compresses fuel, fuel leaks from the displacement amplification chamber 6 through the gap. When the large-diameter piston 3 moves upward, the displacement amplification chamber 6 is reduced in pressure to cause therein negative pressure. Thus, fuel flows from the low-pressure passage 8 through a gap into the displacement amplification chamber 6. Thus, the displacement amplification chamber 6 is regularly filled with specified quantity of fuel. The small-diameter piston 5 has an upper portion slidable inside the small-diameter cylinder 1*b*. The small-diameter piston 5 has a lower portion located in a small-diameter piston bottom chamber 10 downstream of a low-pressure port 9 of the low-pressure passage 8.

A valve chamber 11 accommodates a valve 12 and constructs a three-way valve structure. The valve chamber 11 regularly communicates with a control chamber 14 of a nozzle needle 13 through a main orifice 15 and a control passage 16. The valve 12 is a piston member and movable upward and downward in FIG. 1. The valve 12 has a large-diameter valve portion 12*a*, which is located in the valve chamber 11, and a valve sliding portion 12*b*, which is slodable inside a cavity communicating with a high-pressure port 18 of the high-pressure passage 17. A small diameter portion 12*c* connects the valve portion 12*a* with the valve sliding portion 12*b*. The small diameter portion 12*c* is located in the high-pressure port 18. High-pressure fuel flows from the high-pressure passage 17 through a space around the small diameter section 12*c* into the valve chamber 11. A space 19 is located at the lower side of the valve sliding portion 12*b* of the valve 12. The space 19 accommodates a valve spring 20, which biases the valve 12 upward.

The control chamber 14 is defined by the upper end surface of the nozzle needle 13 and the wall surface defining a vertical cavity 21. The control chamber 14 regularly communicates with the high-pressure passage 17 through a sub-orifice 22. The control chamber 14 is supplied with fuel as control oil from the high-pressure passage 17 through the main orifice 15, the control passage 16, and the valve chamber 11, and thereby the control chamber 14 causes control pressure (back pressure) for actuating the nozzle needle 13. The nozzle needle 13 is applied with the control pressure downward and biased in a seating direction, in addition to being applied with the biasing force of a spring 24 accommodated in the control chamber 14. On the other hand, high-pressure fuel in an accumulator chamber 23 is applied upward to a stepped surface 13*a* and a conical tip end surface 13*b* of the nozzle needle 13, thereby biasing the nozzle needle 13 in a lifting direction so as to inject fuel from nozzle holes 25.

When the valve 12 moves upward, the upper surface of the valve portion 12*a* is seated on an upper valve seat 12*d*, which communicates with the low-pressure port 9, thereby blocking the valve chamber 11 from the low-pressure passage 8. according to the present operation, the control chamber 14 communicates with the high-pressure passage 17 through the valve chamber 11 the control passage 16, and the main orifice 15. High-pressure fuel flows into the control chamber 14, and consequently the control pressure in the nozzle needle 13 increases. Thus, the nozzle needle 13 is downwardly moved and seated to be in the state shown in FIG. 1.

When the valve 12 moves downward, the lower taper surface of the valve portion 12*a* is seated on a lower valve seat 12*e* around the outer circumferential periphery of the high-pressure port 18, thereby blocking the valve chamber 11 from the high-pressure port 18. According to the present operation, the control chamber 14 communicates with the low-pressure passage 8 through the main orifice 15, the control passage 16, the valve chamber 11, and the small-diameter piston bottom chamber 10. Thus, the control pressure in the control chamber 14 decreases, and the nozzle needle 13 is lifted.

When the piezo stack 2 contracts, the valve 12 is applied with fuel pressure in the valve chamber 11 and the biasing force of the valve spring 20; thereby biased upward. Thus, the valve 12 is seated on the upper valve seat 12*d*, and the low-pressure port 9 is closed. The control chamber 14 is blocked from the low-pressure passage 8 and at high pressure. Therefore, the nozzle needle 13 is seated, and fuel is not injected.

Alternatively, when the piezo stack 2 is energized, the piezo stack 2 expands, and the valve 12 is actuated downward, and thus consequently fuel is injected. The valve 12 is a control unit for controlling pressure in the control chamber 14 via the hydraulic pressure transmission mechanism 3, 5, 6. In the present condition, the large-diameter piston 3 of the hydraulic pressure transmission mechanisms 3, 5, 6 is biased downward, and pressure in the displacement amplification chamber 6 increases. The small-diameter piston 5 is displaced downward by being applied with the present pressure. Thus, the valve 12 is moved downward and lifted from the upper valve seat, thereby seated on the lower valve seat 12*e*. According to the present operation, the high-pressure port 18 is blocked, and the control chamber 14 communicates with the low-pressure passage 8 through the main orifice 15, the control passage 16, the valve chamber 11, the low-pressure port 9, and the small-diameter piston bottom chamber 10. Therefore, pressure in the control chamber 14 decreases, and consequently the nozzle needle 13 is lifted, and fuel injection through the nozzle holes 25 starts.

On the other hand, when the piezo stack 2 discharges electricity and contracts by being de-energized, the driving force exerted downward by the hydraulic pressure transmission mechanisms 3, 5, 6 is eliminated. Consequently, fuel injection stops. More specifically, the large-diameter piston 3 and the piezo stack 2 are integrally displaced upward by being exerted with the biasing force of the large-diameter piston spring 4, and consequently pressure in the displacement amplification chamber 6 decreases. Consequently, the downward biasing force of the small-diameter piston 5 is eliminated, and the valve 12 is lifted from the lower valve seat 12*e*, thereby again seated to the upper valve seat 12*d*. In the present condition, the low-pressure port 9 is blocked, and hence pressure in the control chamber 14 is increased by being applied with pressure of high-pressure fuel supplied from the high-pressure passage 17 through the main orifice 15 and the sub-orifice 22. Thus, the nozzle needle 13 is seated, and fuel injection stops.

In response to such injection operations of injection start and injection stop of the fuel injection valve J, the low-pressure passage 8 is supplied with leak fuel caused by increase in pressure inside the displacement amplification chamber 6 of the hydraulic pressure transmission mechanism 3, 5, 6 of the injector J. Furthermore, in response to the injection stop, negative pressure is caused in the displacement amplification chamber 6. Therefore, the displacement amplification chamber 6 is charged with fuel from the low-pressure passage 8. That is, at the time of fuel injection, high-pressure fuel is supplied from the high-pressure passage 17 to the inlet of high-pressure fuel of the injector J, and the injector J injects fuel from the nozzle holes 25. In addition, surplus fuel, such as leak fuel, which leaks from the displacement amplification chamber 6, flows from the back pressure side of the injector J, which communicates with the low-pressure passage 8, to the third surplus fuel passage 81 at the side of the low-pressure passage 8. At the time of the injection stop of fuel from the nozzle holes 25, low-pressure fuel flows from the low-pressure passage 8 into the back pressure side of injector J. Thus, the displacement amplification chamber 6 is charged with fuel.

The low-pressure passage 8 is equivalent to a return fuel passage. The first surplus fuel passage 80*a*, the pressure release passage 80*b*, and the third surplus fuel passage 81 are equivalent to a surplus fuel recovery passage. The back pressure side of the injector J, which communicates with the low-pressure passage 8, in particular, the third surplus fuel passage 81, is equivalent to the back pressure side of the injector J. The injector J is equivalent to a fuel injection device.

Figure 6:
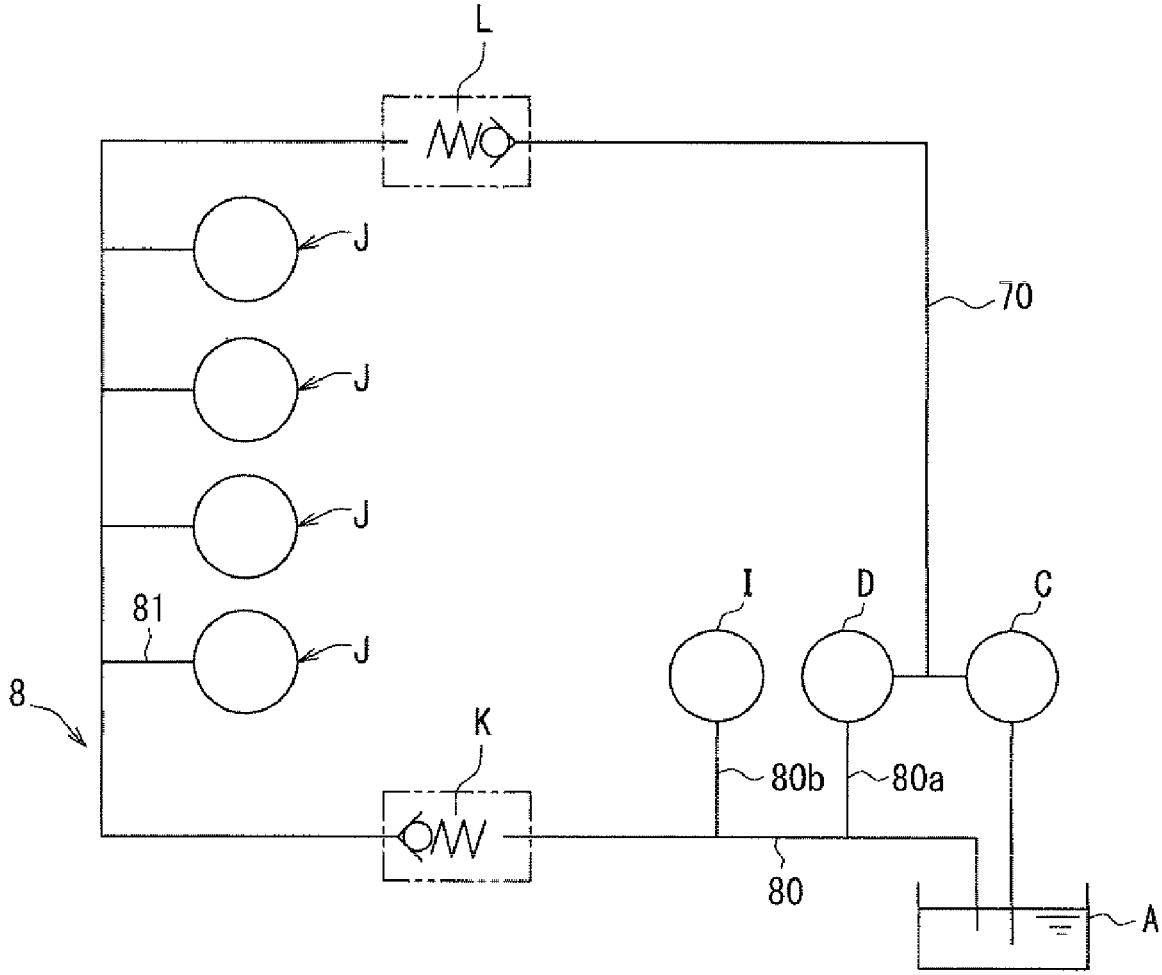
FIG. 6 is a schematic diagram showing a low-pressure fuel system of a diesel engine according to a related art.

Hereafter, one feature of the present first embodiment will be described in detail. FIG. 6 shows a comparative example for explanation of the first embodiment.

In order to maintain the injection performance of the injector J, fuel needs to be steadily charged to and discharged from the displacement amplification chamber 6 at the back pressure side of the injector J in response to the injection operation of the injector J. In particular, steadily charge of fuel is essential. In order to maintain the steady charge and discharge of fuel, at least fuel pressure (back pressure-side pressure) at the side of the back pressure, which communicates with the third surplus fuel passage 81 in the injector J, needs to be maintained at positive pressure. As one method to maintain the positive pressure, it is conceived to provide a check valve K for causing positive pressure fuel in the surplus fuel passage 80, 81, as shown by the comparative example in FIG. 6.

The check valve K is provided, since the surplus fuel of injector J fluctuates according to the engine operation state.

More specifically, for example, when the engine is started, the quantity of surplus fuel is relatively small. In such a condition, the surplus fuel passage 80, 81 may not be filled with fuel in dependence upon the state after stop of the engine. In this case, positive pressure may not be regularly maintained at the side of the back pressure.

In the starting operation of the engine, positive pressure needs to be maintained at the side of the back pressure of the injector J regardless of the normal operation other than the present starting operation. Therefore, as shown by the comparative example in FIG. 6, the outlet of the feed pump C needs to be communicated with the back pressure side of the injector J so as to lead fuel, which his fed from the outlet of the feed pump C, to the back pressure side of the injector J In the present structure, fuel can be steadily charged in the displacement amplification chamber 6 at the back pressure side of the injector J. As a result, injection performance can be maintained.

However, in the low-pressure fuel circuit of the comparative example in FIG. 6, which has the check valve K to maintain positive pressure at the back pressure side of the injector J, the circuit may be regularly communicated in the case where the check valve K causes a defect and regularly opens. When the check valve K causes the defect, fuel fed from the pump C may be discharged to the fuel tank A through the check valve K, which regularly opens due to the defect. As a result, pressure of fuel fed from the feed pump C cannot be maintained, and startability of the engine may be impaired. Thus, engine operation cannot be maintained, and consequently the defect caused in the check valve k results in engine shutdown.

Further, in the low-pressure fuel circuit shown in FIG, 6, the outlet of the feed pump C is directly connected to the back pressure side of the injector J. In this case, a check valve L needs to be provided so as to enable restarting when fuel entrains air. Specifically, the feed pump C properly draws fuel when the fuel tank A receives a proper quantity of fuel. By contrast, for example, when the vehicle runs out of gas, fuel in the fuel tank A becomes significantly small in quantity, and air is entrained in fuel drawn into the feed pump C. In this case, the drawn fuel may contain bubble when filtered through the filter B. When the fuel containing bubble is retained in the feed pump C and the high-pressure pump D, the feed pump C and the high-pressure pump D cannot properly pressurize fuel. In view of the present problem, in the structure of FIG. 6, the check valve L eliminates the fuel containing bubble downstream of the check valve L, and thereby the feed pump C and the high-pressure pump D can properly pump fuel. However, the low-pressure fuel in the comparative example of FIG. 6 includes two additional components as the check valve K and check valve L. Accordingly, the entire system may become expensive.

According to the present embodiment, the outlet of the feed pump C communicates with the back pressure side of the injector J, and the back pressure side of the injector J communicates with the fuel tank A. The low-pressure passage 8 returns surplus fuel to the fuel tank A.

Further, according to the present embodiment, as shown in FIG. 1, the low-pressure passage 8 includes the surplus fuel passages 80, 81 and a backpressure boost passage 70. Furthermore, a backpressure control valve M is provided so as to alternatively select communication and blockade among the surplus fuel passages 80, 81 and the backpressure boost passage 70.

As shown in an FIGS. 1, 3A, the backpressure control valve M includes a valve body 71, a piston 75 as a valve element, a stopper 77 as a regulating unit, which regulates movement of the piston 75 in the axial direction, and a spring 78 as a biasing member, which biases the piston 75.

The valve body 71 is substantially in a cylindrical shape and therein accommodates the piston 75, which is movable inside the valve body 71 in the axial direction. The valve body 71 has an inner circumferential periphery 72*a*, which has an opening (first opening) 91 and an opening (third opening) 92. The opening (first opening) 91 is supplied with fuel from the outlet of the feed pump C. The opening (third opening) 92 leads fuel to the fuel tank A. The inner circumferential periphery 72*a* has an opening end in the axial direction, and the opening end has an opening (second opening) 93 to which surplus fuel is led from the back pressure side of the injector J.

The valve body 71 is a valve casing, which accommodates the piston 75 being movable in the axial direction, the piston 75, the stopper 77, and the spring 78. The valve body 71 is constructed by combining multiple cylindrical members. The valve body includes a cylinder 72, a first body 73, a second body 74, and the like. The cylinder 72 has an inner circumferential periphery 72*a*, in which the piston 75 is inserted. The first body 73 and the second body 74 can be divided into pieces in the axial direction. The first body 73 and the second body 74 support the cylinder 72.

The cylinder 72 is substantially a cylindrical member having the first opening 91, the second opening 93, and the third opening 92. The first opening 91 and the third opening 92 extend through the inner circumferential periphery 72*a* in the radial direction. The cylinder 72 has an opening end, which extends in the axial direction at the side of the second opening 93, and the opening end is provided with a cylindrical plate 76, which regulates an initial position of the piston 75.

The cylinder 72 has an end at the opposite side of the opening end in the axial direction, and the end accommodates a part of the stopper 77. The stopper 77 is partially fixed inside the cavity defined by the inner circumferential periphery 72*a*. The part of the stopper 77 is substantially concentric with the piston 75 and has a projection 77*a*, which projects toward the piston 75. The projection 77*a* has a tip end, which regulates movement of the piston 75 in the axial direction. The projection 77*a* has a cylindrical step portion 77*b* at the root side. The step portion 77*b* supports the spring 78.

The piston 75 is substantially in a cylindrical shape and has an outer wall defining an annular groove 75*a*. An inner passage 75*b* extends between a bottom portion of the annular groove 75*a* and an axial end (plane portion) 75*c* at the side of the second opening 93. The annular groove 75*a* is capable of overlapping the first opening 91 in the movable range of the piston 75 in the axial direction. The annular groove 75*a* and the third opening 92 do not overlap one another. The plane portion 75*c* is capable of overlapping the third opening 92 in the movable range of the piston 75 in the axial direction. The plane portion 75*c* and the first opening 91 do not overlap one another.

As depicted in FIGS. 1, 3A, the piston 75 is in a first control position in which the annular groove 75*a* opens to the first opening 91 when the piston 75 is in contact with the plate 76. Alternatively, as depicted in FIG. 3B, the piston 75 is in a second control position in which the piston 75 is spaced out from the plate 76 and the first opening 91 is blocked from the annular groove 75*a* when the piston 75 moves to a predetermined axial position L1. In FIG. 3B, the piston 75 is in an axial position L2, in which the piston 75 is moved in the axial direction further from the second control position by being applied with the back pressure from the second opening 93. As depicted in FIG. 3C, the piston 75 is in a third control position and in contact with the tip end of the stopper 77 when the piston 75 reaches a predetermined axial position L3 and the first opening 91 is blocked from the annular groove 75*a*.

When the piston 75 is in the first control position, the third opening 92 is blocked from the plane portion 75*c*. When the piston 75 is in the second control position, the plane portion 75*c* begins to open the third opening 92. When the piston 75 is in the third control position, the plane portion 75*c* maintains communication of the third opening 92.

The cylinder 72 and the plate 76 are inserted into the cavity defined by an inner circumferential periphery 73*a* of the first body 73 and fixed to the first body 73. In the present structure, the inner circumferential periphery 73*a* of the first body 73 is positioned with respect to a peripheral wall portion 72*b* of the cylinder 72. In the present embodiment, in the cylinder 72, which is substantially in a cylindrical shape, the peripheral wall portion 72*b* at the side of the first opening 91 projects outward in the radial direction. In addition, the inner circumferential periphery 73*a* of the first body 73, which is substantially in the cylindrical shape, has a recess 73*b*, which is fitted to the peripheral wall portion 72*b*.

In the present structure, in which the first body 73 is positioned with respect to the cylinder 72, the inner circumferential periphery 73*a* of the first body 73 opens to the third opening 92, and has a recess groove 73*c*. The recess groove 73*c* extends in the axial direction at the side of the stopper 77. The first body 73 has a first piping portion and a third piping portion. The first piping portion has a first communication passage 95, which communicates with the first opening 91. The third piping portion has a third communication passage 97, which communicates with the second opening 93 through the plate 76.

The second body 74, which is substantially in a cylindrical shape, is fixed in the axial direction to the end of the first body 73 is at the opposite side of the third communication passage 97, and thereby accommodating the components 72, 75, 76, 77, 78 of the backpressure control valve M. The second body 74 has a second piping portion, which has a second communication passage 96 communicating with the third opening 92 through the recess groove 73*c*.

Sealing members such as O-ring are respectively provided to a connecting portion between the first opening 91 and the first communication passage 95 and a fitted portion between the first body 73 and the second body 74.

Next, an operation of the backpressure control valve M having the above configuration will be described with reference to FIGS. 1 to 3C. FIGS. 3A to 3C respectively depict the backpressure control valve M in a condition at starting of the engine, a normal operation, and a condition in which malfunction occurs therein.

The surplus fuel passage 81 connects the second opening 93 of the backpressure control valve M with the back pressure side of the injector J. The surplus fuel passage 80 connects the third opening 92 of the backpressure control valve M with the fuel tank A. Fuel overflows from the high-pressure pump D, and the overflowing fuel flows into the surplus fuel passage 80 through the second surplus fuel passage. Fuel is decompressed in the pressure regulator valve I, and the decompressed fuel flows into the surplus fuel passage 80 through the pressure release passage 80*b*. The backpressure boost passage 70 connects the first opening 91 of the backpressure control valve M with the outlet of the feed pump C.

(Stop Operation of Engine)

At the time of a stop operation of the engine, the feed pump C and the high-pressure pump D, which are configured to be actuated by driving force generated by the engine, are stopped. Therefore, fuel is not drawn from the fuel tank A and is not partially recirculated to the fuel tank A in the high-pressure fuel system 100 and the low-pressure fuel system 200. For example, fuel remaining in components C, D, E, I, M of the fuel injection system, more specifically, fuel in the compression chambers of the pump casings of the feed pump C and the high-pressure pump D is gradually returned to the fuel tank A by being applied with gravity force. Therefore, for example, the low-pressure passage 8, which includes the backpressure boost passage 70 and the surplus fuel passages 80, 81, and the displacement amplification chamber 6 at the back pressure side of the injector J may not be filled with fuel.

(Start Operation of Engine)

The feed pump C and the high-pressure pump D respectively feed fuel to the high-pressure pump D and feed high-pressure fuel to the common rail E in response to start of the engine. In general, the feed pump C and the high-pressure pump D respectively have a capacity required for feeding a sufficient amount of fuel to the high-pressure pump D and a capacity sufficiently greater than the injection quantity required at the side of the common rail E. Therefore, pressure at the side of the inlet of the high-pressure pump D and pressure in the backpressure boost passage 70 increase to be equal to or greater than predetermined feed pressure in a short time period.

In such a starting operation, the piston 75 is not applied with pressure at the back pressure side of the injector J. Therefore, as shown in FIG. 3A, the piston 75 is in the first control position. Therefore, the first opening 91 communicates with the second opening 93, and hence the surplus fuel passage 81 communicates with the backpressure boost passage 70. Whereby, the outlet of the feed pump C communicates with the back pressure side of the injector J. In the present operation, fuel, which is increased in pressure within a short time period, is supplied to the back pressure side of the injector J in response to the engine start. Therefore, fuel at the back pressure side of the injector J is increased in pressure, and as a result, the fuel in positive pressure is steadily supplied to the back pressure side of the injector J.

(Normal Operation of Engine)

In a normal operation other than the engine start, surplus fuel, such as leak fuel from the injector J, increases according to a specific operating condition such as increase in engine rotation speed. Therefore, pressure at the back pressure side of the injector J further increases.

When pressure at the back pressure side of the injector J increases, the piston 75 moves in the axial direction to the right side in FIG. 1 by being applied with pressure at the side of the back pressure side of the injector J. The piston 75 further moves according to balance between the increasing pressure at the back pressure side of the injector J and the biasing force of the spring 78. When the piston 75 reaches the second control position shown in FIG. 3B, the first opening 91 is blocked by the outer circumferential periphery of the piston 75 other than the annular groove 75*a*. On the other hand, the second opening 93 communicates with the third opening 92, and as a result, the surplus fuel passage 81 communicates with the surplus fuel passage 80. Therefore, the back pressure side of the injector J is not supplied with fuel, and surplus fuel, which is increased in quantity, returns from the back pressure side of the injector J to the fuel tank A through the backpressure control valve M.

In the present structure, the backpressure control valve M is capable of maintaining the back pressure side at positive pressure while returning the surplus fuel from the injector J to the fuel tank A without excessively increasing pressure at the back pressure side of the injector J due to pressure of fuel fed from the feed pump C.

(Malfunction of Backpressure Control Valve M)

In the backpressure control valve M, the control position of the piston 75 is determined in accordance with the balance between the pressure at the back pressure side and the biasing force of the spring 78. Therefore, when malfunction such as failure or breakage of the spring 78 occurs, the spring 78 loses the biasing force, and as a result, the balance cannot be maintained.

When such a malfunction occurs in the backpressure control valve M, the piston 75 continues moving in the axial direction to the right side by applied with only the pressure at the back pressure side. However, as shown in FIG. 3C, the piston 75 makes contact with the tip end of the stopper 77, and therefore the movement of the piston 75 is regulated by the stopper 77. Thus, the piston 75 is maintained at the third control position. In the present third control position, the communication between the second opening 93 and the third opening 92 is maintained, and whereby communication between the surplus fuel passage 81 and the surplus fuel passage 80 is maintained.

In addition, when such a malfunction occurs in the backpressure control valve M, the outlet of the feed pump C is blocked from the fuel tank during the operation of the engine such as the engine start and the normal operation. Therefore, the performance of the feed pump C is not spoiled, and the feed pressure of the feed pump C can be maintained.

According to the present embodiment described above, the low-pressure fuel system includes the low-pressure passage 8, which is configured to communicate the outlet of the feed pump C with the back pressure side of the injector J and configured to communicate the fuel tank A with the back pressure side of the injector J so as to return surplus fuel to the fuel tank A. The backpressure control valve M for the low-pressure fuel system includes a switching unit. In the starting operation, the switching unit communicates the outlet of the feed pump C with the back pressure side of the injector J, the switching unit blocks the outlet of the feed pump C from the fuel tank A, and the switching unit blocks the back pressure side of the injector J from the fuel tank A. In the normal operation, the switching unit communicates the back pressure side of the injector J with the fuel tank A, the switching unit blocks the outlet of feed pump C from the fuel tank A, and the switching unit blocks the outlet of the feed pump C from the back pressure side of the injector J.

According to the present structure, the backpressure control valve M communicates the outlet of the feed pump C with the back pressure side of the injector J in the starting operation, in which increasing in pressure at the back pressure side of the injector J may become insufficient. Therefore, pressure at the back pressure side of the injector J can be increased with fuel fed from the feed pump C.

Alternatively, in the normal operation other than the starting operation, the backpressure control valve M communicates the back pressure side of the injector J with the fuel tank A and blocks the outlet of the feed pump C from the back pressure side of the injector J. Therefore, relatively sufficient surplus fuel is discharged from the back pressure side of the injector J in the normal operation. Thus, surplus fuel is sufficiently returned to the fuel tank A. In addition, the back pressure side of the injector J is maintained at positive pressure, while being restricted from excessively increasing in pressure due to fuel fed from the feed pump.

In addition, the backpressure control valve M regularly blocks the outlet of the feed pump C from the fuel tank A in both the starting operation and the normal operation. Thus, the performance of the feed pump C is not spoiled, and the feed pressure of the feed pump C can be maintained.

According to the present embodiment, the back pressure side of the injector J is maintained at positive pressure. In addition, the outlet of the feed pump C is regularly blocked from the fuel tank A. Thus, regular communication between the outlet of the feed pump C and the fuel tank A can be avoided, and the starting operation can be properly conducted.

According to the present embodiment described above, the backpressure control valve M includes the valve body 71, the piston 75, and the stopper 77. The valve body 71 has the first opening 91, to which fuel is fed from the outlet of the feed pump C, the second opening 93, to which fuel is fed from the back pressure side of the injector J, and the third opening 92, which leads fuel to the fuel tank A. The piston 75 is inserted in the valve body 71 and movable in the axial direction. The piston 75 moves in the axial direction in response to pressure at the back pressure side of the injector J so as to control communication between the first opening 91 and the second opening 93, communication between the second opening 93 and the third opening 92, and communication (blockade) between the first opening 91 and the third opening 92. The stopper 77 regulates movement of the piston 75 in the axial direction at least in a predetermined movable range, in which the piston 75 is movable in the axial direction inside the valve body 71 when the piston 75 is applied with pressure at the back pressure side of the injector J.

When pressure at the back pressure side increases and thereby the piston 75 reaches a predetermined position in the axial direction, the stopper 77 regulates the movement of the piston 75. In the present condition, the backpressure control valve M maintains a state in which the back pressure side of the injector J is communicated with the fuel tank A, the outlet of the feed pump C is blocked from the fuel tank A, and the outlet of the feed pump C is blocked from the back pressure side of the injector J in the normal operation.

According to the present embodiment, at least the stopper 77 is provided for regulating movement of the piston 75 within the movable range in the axial direction when the piston 75 moves in response to application of pressure at the back pressure side, at least. Therefore, pressure at the back pressure side is sufficiently increased, and the stopper 77 regulates the movement of the piston 75 when the pressure becomes greater than predetermined pressure. In the present state, in which the pressure at the back pressure side is sufficiently increased, the backpressure control valve M regularly maintains the state in which the back pressure side of the injector J is communicated with the fuel tank A, the outlet of the feed pump C is blocked from the fuel tank A, and the outlet of the feed pump C is blocked from the back pressure side of the injector J, correspondingly to the normal operation.

Further, in the present normal operation state of the backpressure control valve M, the piston 75 communicates the second opening 93 with the third opening 92, the piston 75 blocks the first opening 91 from the third opening 92, and the piston 75 blocks the first opening 91 from the second opening 93.

According to the present structure, predetermined set pressure at the back pressure side, at which the back pressure side of the injector J communicates with the fuel tank A, can be set at a value different from feed pressure of fuel. That is, the predetermined set pressure may be determined substantially regardless of the feed pressure of fuel from the feed pump C. According to the present structure, the function of the check valve K and the check valve L shown in FIG. 6 can be produced with one component of the backpressure control valve M. Therefore, pressure at the back pressure side of the injector J can be maintained at positive pressure, while suppressing the number of components. Furthermore, regular communication between the outlet of the feed pump C and the fuel tank A can be avoided in the low-pressure fuel system.

Further, according to the present embodiment as described above, the spring 78 is provided to bias the piston 75 in the direction, which is opposite to the direction in which the piston 75 moves in response to application of pressure at the side of the back pressure side of the injector J. According to the present structure, the set pressure at the back pressure side can be controlled by modifying the biasing force of the spring 78.

Moreover, when the spring 78 breaks and causes a malfunction therein, the spring 78 is incapable of generating the biasing force. Therefore, the backpressure control valve M causes a malfunction. Even in the present condition, in which the piston 75 continues moving in response to pressure at the back pressure side, the movement of the piston 75 is steadily regulated by the stopper 77, while blocking the outlet of the feed pump C from the fuel tank A. The backpressure control valve M regularly maintains the state in which the back pressure side of the injector J is communicated with the fuel tank A, the outlet of the feed pump C is blocked from the fuel tank A, and the outlet of the feed pump C is blocked from the back pressure side of the injector J, correspondingly to the normal operation.

In the present embodiment as described above, the predetermined set pressure at the back pressure side controlled by the backpressure control valve M is preferably set less than predetermined set pressure of fuel fed from the feed pump C controlled by the regulator valve Cr. The predetermined set pressure at the back pressure side is adjusted by modifying the biasing force of the spring 78 or the opening area of the third opening 92, for example.

According to the present adjustment, the predetermined set pressure of the backpressure control valve M at the back pressure side of the injector J is lower than the feed pressure of the feed pump C controlled at the predetermined set pressure. Therefore, pressure, at which the injection valve opens, can be easily adjusted, and as a result, the injector J can be enhanced in reliability.

In the low-pressure fuel system, the pressure regulator valve I is provided in the low-pressure opening passage through which the common rail pressure is applied from the common rail E to the low-pressure side (low-pressure component). In the present structure, for example, it is conceived that decompressed fuel may be discharged by opening the pressure regulator valve I so as to maintain the back pressure side at positive pressure.

However, in general, such a pressure regulator valve may have an electromagnetic valve structure, which is opened or closed when being energized. In such a case, the pressure regulator valve has either a normally close structure or a normally open structure. When such a pressure regulator valve I causes a malfunction, the pressure release passage (low-pressure opening passage) may be regularly blocked or communicated. When the pressure regulator valve I causes such a malfunction, pressure at the back pressure of the injector J may be excessively increased in a case of the normally open structure, or the back pressure side of the injector J cannot be controlled at positive pressure in a case of the normally close structure.

On the centrally, according to the present embodiment, the backpressure control valve M connects with both the backpressure boost passage 70 and the surplus fuel passages 80, 81 to switch communication and blockade among the backpressure boost passage 70 and the surplus fuel passages 80, 81. Therefore, even when the pressure regulator valve I or the backpressure control valve M is broken, excessive increase in pressure at the back pressure side can be avoided, and the back pressure side can be regularly maintained at positive pressure.

Second Embodiment

Figure 4:
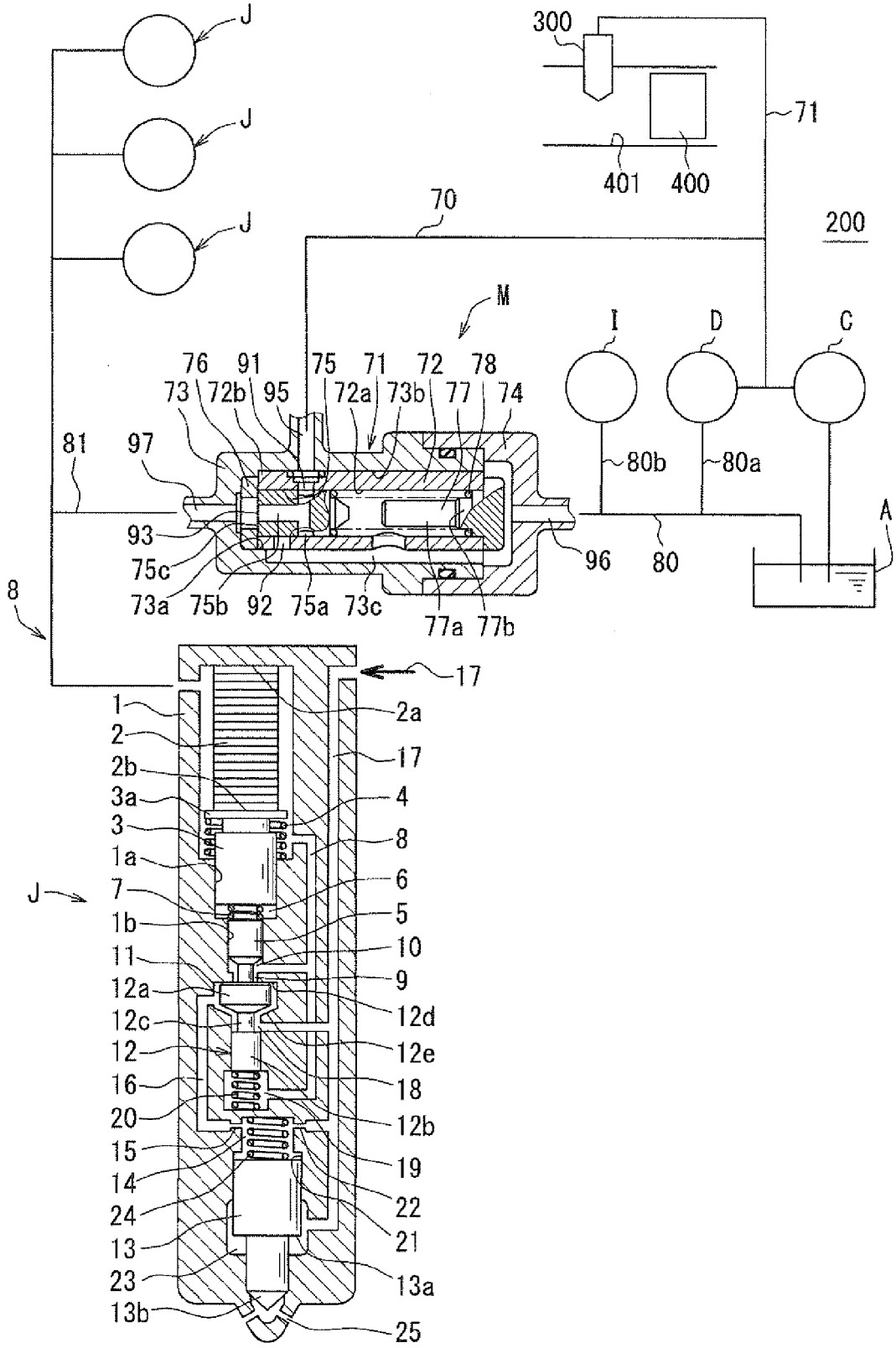
FIG. 4 is a schematic diagram showing the backpressure control valve applied to a low-pressure fuel system according to a second embodiment.

FIG. 4 depicts the second embodiment. According to the second embodiment, the low-pressure fuel system 200 includes an addition valve 300. The addition valve 300 is used for a reduction purifying device 400, which is provided to an exhaust passage 401 of the engine to perform reduction (re-oxidation) to purify exhaust gas. The reduction purifying device 400 may be a diesel particulate filter (DPF), for example.

As shown in FIG. 4, the addition valve 300 is connected to the outlet of the feed pump C. More specifically, the addition valve 300 is, for example, connected with an addition fuel passage 170, which branches from the backpressure boost passage 70, and configured to feed fuel as reducing agent. The addition valve 300 includes a fuel injection nozzle and a solenoid, which controls lift of a valve element to control fuel injection through the nozzle, and the like. The addition valve 300 controls fuel injection according to a control signal from the control circuit G.

The addition valve 300 is located upstream of the reduction purifying device 400 so as to inject a part of fuel, which flows through the backpressure boost passage 70, as reducing agent.

In the low-pressure fuel system provided with the addition valve 300, when the outlet of the feed pump C regularly communicates with the back pressure side of the injector J, relatively sufficient surplus fuel flows from the back pressure side of the injector J into the addition fuel passage 170 in the normal operation. The flow of the surplus fuel fluctuates according to the rotation speed of the engine. Accordingly, the fluctuation in flow of the surplus fuel may exert influence to pressure of fuel in the addition fuel passage 170.

On the contrary, according to the present embodiment, the backpressure control valve M has a switching unit configured to block the outlet of the feed pump C from the back pressure side of the injector J in the normal operation. In the present structure, the backpressure control valve M is configured to block the backpressure boost passage 70 at the side of the addition valve 300. Thus, the surplus fuel, which flows from the back pressure side of the injector J, can be restricted from exerting influence to cause pressure fluctuation in the addition fuel passage 170 at the side of the addition valve 300.

Third Embodiment

Figure 5:
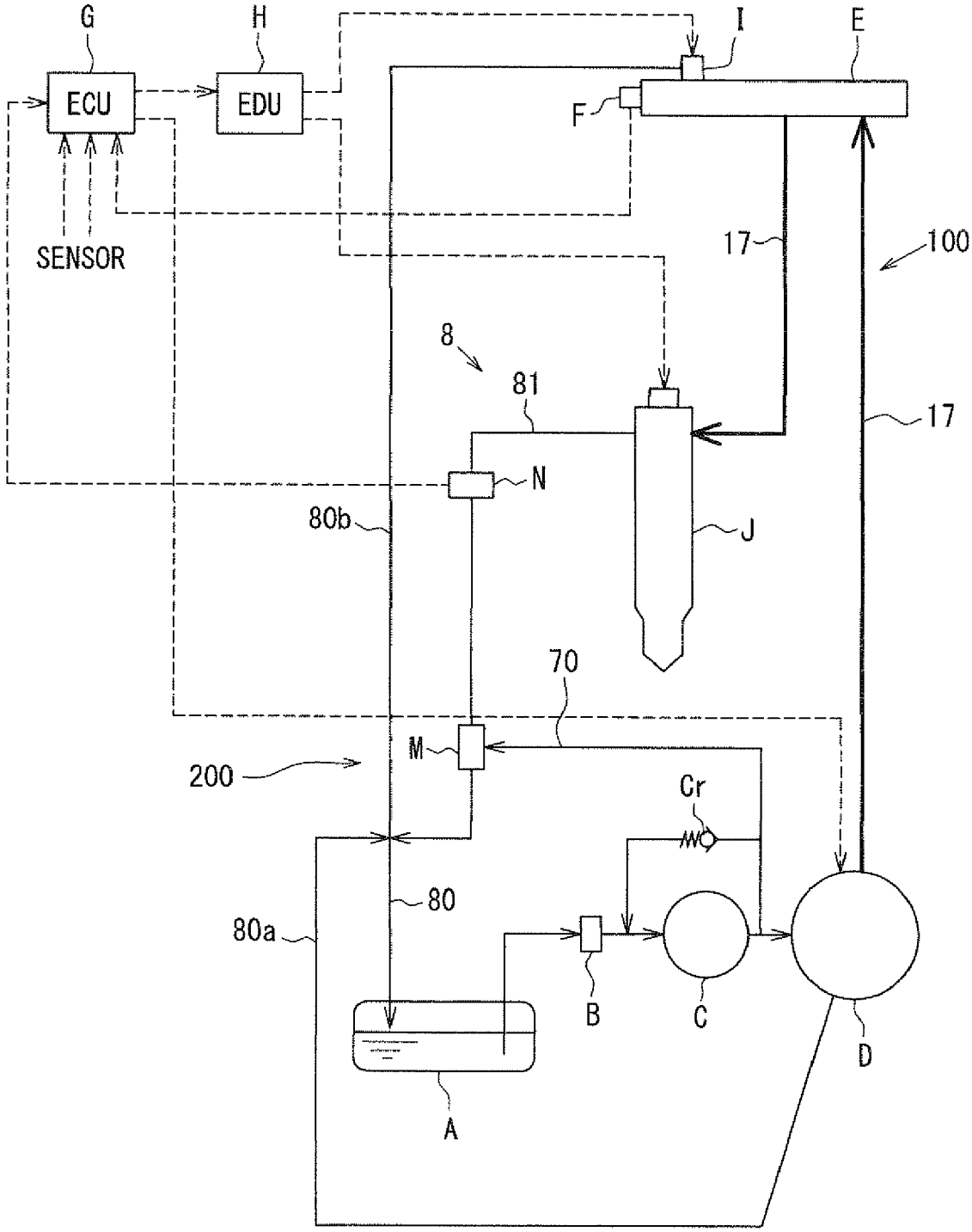
FIG. 5 is a schematic diagram showing the backpressure control valve applied to a low-pressure fuel system according to a second embodiment.

FIG. 5 depicts the third embodiment. According to the present third embodiment, a pressure sensor (backpressure side pressure sensor) N is provided to the surplus fuel passage 81 at the back pressure side of the injector J in the low-pressure passage 8. In addition, a determination unit is provided for determining occurrence of a malfunction at the back pressure side.

As shown in FIG. 5, the backpressure side pressure sensor N is provided to the surplus fuel passage 81 for detecting pressure at the back pressure side in the surplus fuel passage 81. The control circuit G inputs pressure signal outputted from the backpressure side pressure sensor N. The control circuit G determines occurrence of a malfunction at the backpressure side based on the output of the backpressure side pressure sensor N.

For example, when the backpressure control valve M is normal, i.e., the backpressure control valve M does not cause a malfunction, the backpressure control valve M controls pressure at the back pressure side at the predetermined set pressure in both the starting operation and the normal operation. By contrast, when the backpressure control valve M causes a malfunction due to, for example, breakage of the spring 78, pressure at the back pressure side becomes uncontrollable. In this case, pressure at the back pressure side becomes, for example, lower than the predetermined set pressure in the starting operation and the normal operation.

The control circuit G controls decompressed fuel, which flows from the pressure regulator valve I to the pressure release passage 80*b*, at an optimal quantity according to the engine operation state. When the pressure regulator valve I, which has, for example, a normally open structure, is normal, fluctuation in pressure in the backpressure side caused by influence of the decompression fuel is suppressed small. On the contrary, when the pressure regulator valve I causes a malfunction, the pressure regulator valve I regularly communicates therethrough, and consequently the malfunction of the pressure regulator valve I significantly exerts influence to fluctuation in pressure at the back pressure side.

In the present embodiment, the backpressure side pressure sensor N is configured to detect pressure at the back pressure side. Therefore, a component such as the pressure regulator valve I and the backpressure control valve M causing a malfunction can be specifically identified according to magnitude of and fluctuation in pressure at the back pressure side.

Other Embodiment

As described above, the present invention is not limited to the above embodiment, and is capable of being applied to various embodiments as long as being undeviating from the gist thereof.

For example, the fuel injection device is not limited to the piezo injector J. It suffices that the fuel injection device has a structure, in which surplus fuel such as leak fuel is discharged from a back pressure side of an injector in conjunction with fuel injection, and the injector is supplied with fuel. The fuel injection device may be a device other than an injector.

In the above embodiments, the high-pressure passage 17 may be equivalent to a passage from the outlet of the high-pressure fuel supply pump D to the high-pressure passage 17 inside the injector J. In addition, the low-pressure passage 8 may include the surplus fuel passage 80 and the backpressure boost passage 70. The surplus fuel passage 80 extends from the low-pressure passage 8, which includes the displacement amplification chamber 6 in the injector J, to the fuel tank A through the backpressure control valve M. The backpressure boost passage 70 extends to the outlet of the feed pump C and is different from the passage 80. In the above embodiments, pressure at the back pressure lateral side is increased only by fuel fed from the feed pump C so as to maintain the back pressure side of the injector J at positive pressure. Alternatively, the back pressure side of the injector J may be maintained at positive pressure by feeding both the fuel fed from the feed pump C and fuel decompressed from the pressure regulator valve I. In this case, the pressure regulator valve I is preferably a normally close type electromagnetic valve.

In the above embodiments, the backpressure control valve is applied to the low-pressure fuel system of the common rail type fuel injection system of the diesel engine for the vehicle. Alternatively, the backpressure control valve in the above embodiments may be applied to a fuel injection system of a gasoline engine. Further, the backpressure control valve may be applied to a fuel injection system for an engine of an apparatus other than a vehicle.

The above structures of the embodiments can be combined as appropriate.

The above processings such as calculations and determinations may be performed by any one or any combinations of software, an electric circuit, a mechanical device, and the like. The software may be stored in a storage medium, and may be transmitted via a transmission device such as a network device. The electric circuit may be an integrated circuit, and may be a discrete circuit such as a hardware logic configured with electric or electronic elements or the like. The elements producing the above processings may be discrete elements and may be partially or entirely integrated.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

The present invention may be applied to a method for an operation, which includes communicating the outlet of the low-pressure fuel pump B with the back pressure side 81 simultaneously with blocking the fuel tank A from both the outlet of the low-pressure fuel pump B and the back pressure side 81 in the starting operation; and communicating the back pressure side 81 with the fuel tank A simultaneously with blocking the outlet of the low-pressure fuel pump B from the fuel tank A and the back pressure side 81 in the normal operation subsequent to the starting operation.

What is claimed is:

1. A backpressure control valve for a low-pressure fuel system having a return fuel passage, which is configured to communicate an outlet of a low-pressure fuel pump, which is for drawing fuel from a fuel tank, with a back pressure side of a fuel injection device, the return fuel passage configured to partially return pressurized fuel from the back pressure side to the fuel tank and control fuel pressure at the back pressure side in response to fuel injection from the fuel injection device to an internal combustion engine, the backpressure control valve comprising:

a switching unit configured to control communication between the outlet of the low-pressure fuel pump and the back pressure side, communication between the back pressure side and the fuel tank, and communication between the outlet of the low-pressure fuel pump and the fuel tank, wherein in a starting operation:

the switching unit communicates the outlet of the low-pressure fuel pump with the back pressure side;

the switching unit blocks the outlet of the low-pressure fuel pump from the fuel tank; and the switching unit blocks the back pressure side from the fuel tank, wherein in a normal operation:

the switching unit communicates the back pressure side with the fuel tank;

the switching unit blocks the outlet of the low-pressure fuel pump from the fuel tank; and the switching unit blocks the outlet of the low-pressure fuel pump from the back pressure side.

2. The backpressure control valve according to claim 1, wherein the switching unit includes:

a valve body, which has a first opening configured to be fed with fuel from the outlet of the low-pressure fuel pump, a second opening configured to communicated with the back pressure side, and a third opening configured to lead fuel to the fuel tank;

a valve element movable in an axial direction in the valve body by being applied with fuel pressure at the back pressure side and configured to control communication between the first opening and the second opening, communication between the second opening and the third opening, and communication between the first opening and the third opening; and a regulating unit configured to regulate movement of the valve element in the valve body within a predetermined movement in a movable range in which the valve element is movable in the axial direction by being applied with at least fuel pressure at the back pressure side, wherein the regulating unit regulates the movement of the valve element when the valve element reaches the predetermined movement in response to increase in fuel pressure at the back pressure side, wherein in the normal operation, the regulating unit maintains a condition where:

the back pressure side is communicated with the fuel tank;

the outlet of the low-pressure fuel pump is blocked from the fuel tank; and the outlet of the low-pressure fuel pump is blocked from the back pressure side.

3. The backpressure control valve according to claim 2. wherein in the normal operation:

the valve element communicates the second opening with the third opening, the valve element blocks the first opening from the third opening; and the valve element blocks the first opening from the second opening.

4. The backpressure control valve according to claim 2, further comprising:

a biasing member configured to bias the valve element in a first direction opposite to a second direction in which the valve element moves by being applied with fuel pressure at the back pressure side.

5. The backpressure control valve according to claim 1, wherein the switching unit is configured to control pressure at the back pressure side at first set pressure, the low-pressure fuel pump is configured to feed fuel controlled in pressure at second pressure, and the first set pressure is less than the second pressure.

6. A Low-pressure fuel system comprising:

the backpressure control valve according to claim 1;

the low-pressure fuel pump configured to preliminary pump fuel from the fuel tank to feed low-pressure fuel;

a high-pressure pump configured to further pump the low-pressure fuel to press-feed high-pressure fuel; and an injector as the fuel injection device configured to be supplied with the high-pressure fuel from the high-pressure pump, wherein the return fuel passage includes:

a backpressure side boost passage, which connects the outlet of the low-pressure fuel pump with the back pressure side of the injector for supplying the low-pressure fuel to the back pressure side; and a surplus fuel recovery passage, which connects the back pressure side of the injector with the fuel tank for exhausting fuel partially from the back pressure side of the injector in response to fuel injection of the injector, wherein the backpressure control valve is configured to control communication between the backpressure side boost passage and the surplus fuel recovery passage.

7. The low-pressure fuel system according to claim 6, further comprising:

a common rail provided between the injector and the high-pressure pump to accumulate the high-pressure fuel press-fed from the high-pressure pump and configured to distribute the accumulated high-pressure fuel to the injector provided to each of a plurality of locations in the internal combustion engine;

a pressure release passage configured to release fuel pressure in the common rail to a low-pressure component; and a pressure regulator valve configured to control communication in the pressure release passage, wherein the pressure release passage is connected with one of the backpressure side boost passage and the surplus fuel recovery passage.

8. The low-pressure fuel system according to claim 6, further comprising:

a reduction purifying device for performing reduction purification of exhaust air of the internal combustion engine; and an addition valve provided in an exhaust passage of the internal combustion engine, wherein the addition valve is configured to partially inject fuel, which flows through the backpressure side boost passage, as reducing agent to an inside of the exhaust passage upstream of the reduction purifying device.

9. The low-pressure fuel system according to claim 6, further comprising:

a pressure detection unit provided between the backpressure control valve and the back pressure side in the backpressure side boost passage and the surplus fuel recovery passage for detecting fuel pressure at the back pressure side; and a determination unit configured to determine occurrence of a malfunction at the back pressure side based on a detection result of the pressure detection unit.

10. The backpressure control valve according to claim 1, wherein in the starting operation, the internal ombustio engine is being started, and the normal operation is subsequent to the starting operation.

* * * * *